US006250225B1

(12) United States Patent
Rompuy et al.

(10) Patent No.: US 6,250,225 B1
(45) Date of Patent: Jun. 26, 2001

(54) THERMAL LITHOGRAPHIC PRINTING PLATE PRECURSOR WITH EXCELLENT SHELF LIFE

(75) Inventors: Ludo Van Rompuy, Mortsel; August Meisters, Gentbrugge; Luc Leenders, Herentals, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/339,163

(22) Filed: Jun. 24, 1999

Related U.S. Application Data

(60) Provisional application No. 60/100,569, filed on Sep. 16, 1998.

(30) Foreign Application Priority Data

Jul. 16, 1998 (EP) ..... 98202382

(51) Int. Cl.[7] ..... B41C 1/10
(52) U.S. Cl. ..... 101/467; 101/457; 430/302
(58) Field of Search ..... 101/456, 457, 101/462, 465–467, 478; 430/200, 201, 270.1, 302

(56) References Cited

U.S. PATENT DOCUMENTS

| | | | | |
|---|---|---|---|---|
| 3,619,157 | * | 11/1971 | Brinckman | 101/467 |
| 3,945,318 | * | 3/1976 | Landsman | 101/467 |
| 4,245,003 | * | 1/1981 | Oransky et al. | 101/467 |
| 4,711,834 | * | 12/1987 | Butters et al. | 430/302 |
| 5,713,287 | | 2/1998 | Gelbart | 101/467 |
| 5,989,772 | * | 11/1999 | Tutt et al. | 430/201 |
| 5,998,088 | * | 12/1999 | Robello et al. | 430/201 |
| 6,001,530 | * | 12/1999 | Kidnie et al. | 430/201 |
| 6,001,536 | * | 12/1999 | Vermeersch et al. | 101/456 |
| 6,017,677 | * | 1/2000 | Maemoto et al. | 101/467 |
| 6,030,750 | * | 2/2000 | Vermeersch et al. | 101/467 |

FOREIGN PATENT DOCUMENTS

| | | | |
|---|---|---|---|
| 2195826 | * | 7/1997 | (CA) . |
| 0 198 14 877 | | 10/1998 | (DE) . |
| 0 084 444 | | 7/1983 | (EP) . |
| 099 264 | * | 1/1984 | (EP) . |

* cited by examiner

*Primary Examiner*—Stephen R. Funk
(74) *Attorney, Agent, or Firm*—Breiner & Breiner

(57) ABSTRACT

A negative working non-ablative lithographic printing plate precursor is provided which includes a metal support such as an anodized aluminum plate and provided thereon a layer or a stack of layers, wherein at least one layer includes a near infrared light absorbing compound which is the main component of the layer(s). As the amount of other reactive compounds besides the near infrared light absorbing compound is less than 20% by weight, excellent-storage stability is obtained. In a highly preferred embodiment the layer or stack of layers is substantially free from the other reactive compounds. The material is very suitable for computer-to-plate and computer-to-press applications as it can be used as a printing master directly after exposure or may be processed by rinsing with plain water.

15 Claims, No Drawings

THERMAL LITHOGRAPHIC PRINTING PLATE PRECURSOR WITH EXCELLENT SHELF LIFE

The application claims the benefit of U.S. Provisional Application No. 60/100,569 filed Sep. 16, 1998.

FIELD OF THE INVENTION

The present invention relates to a heat-mode lithographic printing plate precursor which is sensitive to near infrared light and to methods for making a lithographic printing master in computer-to-plate and computer-to-press procedures.

BACKGROUND OF THE INVENTION

Rotary printing presses use a so-called master such as a printing plate which is mounted on a cylinder of the printing press. The master carries an image which is defined by the ink accepting is areas of the printing surface and a print is obtained by applying ink to said surface and then transferring the ink from the master onto a substrate, which is typically a paper substrate. In conventional lithographic printing, ink as well as an aqueous fountain solution are fed to the printing surface of the master, which is referred to herein as lithographic surface and consists of oleophilic (or hydrophobic, i.e. ink accepting, water repelling) areas as well as hydrophilic (or oleophobic, i.e. water accepting, ink repelling) areas.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently:

(i) On-press imaging. A special type of a computer-to-plate process, involves the exposure of a plate precursor while being mounted on a plate cylinder of a printing press by means of an image-setter that is integrated in the press. This method may be called 'computer-to-press' and printing presses with an integrated image-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. The best known imaging methods are based on ablation. A problem associated with ablative plates is the generation of-debris which is difficult to remove and may disturb the printing process or may contaminate the exposure optics of the integrated image-setter. Other methods require processing with chemicals which may damage the electronics and other devices of the press.

(ii) On-press coating. Whereas a plate precursor normally consists of a sheet-like support and one or more functional coatings, computer-to-press methods have been described wherein a composition, which is capable to form a lithographic surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure. The latter method requires a curing step and the polymers are quite expensive because they are thermally unstable and therefore difficult to synthesize. EP-A 802 457 describes a hybrid method wherein a functional coating is provided on a plate support that is mounted on a cylinder of a printing press. This method also needs processing.

(iii) Elimination of chemical processing. The development of functional coatings which require no processing or may be processed with plain water is another major trend in plate making. WO 90002044, WO 91008108 and EP-A 580 394 disclose such plates, which are, however, all ablative plates. In addition, these methods require typically multi-layer materials, which makes them less suitable for on-press coating. A non-ablative plate which can be processed with plain water is described in e.g. EP-A 770 497 and EP-A 773 112. Such plates also allow on-press processing, either by wiping the exposed plate with water while being mounted on the press or by the fountain solution during the first runs of the printing job.

(iv) Thermal imaging. Most of the computer-to-press methods referred to above use so-called thermal materials, i.e. plate precursors or on-press coatable compositions which comprise a compound that converts absorbed light into heat. The heat which is generated on image-wise exposure triggers a (physico-)chemical process, such as ablation, polymerization, insolubilization by cross-linking of a polymer, decomposition, or particle coagulation of a thermoplastic polymer latex. This heat-mode process then results in a lithographic surface consisting of ink accepting and ink repelling areas. In addition to some of the disadvantages of the prior art materials and methods, indicated above, a major problem associated with all the known non-ablative thermal materials is the limited shelf life. Because these materials all contain one or more reactive compounds, the stability is highly dependent on temperature and/or humidity conditions during storage.

Another problem associated with most thermal materials disclosed in the prior art is that these materials are suitable for exposure with either an internal drum image-setter (i.e. typically a high-power short-time exposure) or an external drum image-setter (i.e. relatively low-power long-time exposure). Providing a universal material that can be exposed with satisfactory results on both these types of laser devices known in the art is a requirement difficult to fulfill.

EP-A084444 describes a printing plate precursor comprising aluminum silicate as image forming material. Upon laser exposure, the aluminum silicate is converted to a more oleophilic form. However, the difference in oleophilicity between exposed and unexposed areas is rather low and it is necessary to apply a coating which comprises an organic, oleophilic phase that preferentially wets and deposits on the exposed areas and an aqueous phase that preferentially wets and deposits on the unexposed areas. This system does not fulfill the requirement of needing no processing.

DE-A-19814877 describes a printing member wherein a hydrophilic zirconium oxide ceramic is converted upon exposure into an oleophilic phase. This system is characterized by a low speed, requiring the use of a very powerful, Q-switched Nd:YAG laser and, accordingly, does not fulfill the requirement of being universally exposable.

SUMMARY OF THE INVENTION

It is an object of the present invention to provide a material which is suitable for making a printing master for conventional lithographic printing by using computer-to-plate, computer-to-press or on-press coating methods and can be manufactured in a cost efficient way and requires no processing or can be processed with plain water. It is a particular object of the present invention to provide a heat-mode material which is sensitive to near infrared light but is also characterized by an excellent stability thereby guaranteeing a long shelf life. It is still another object of the present invention to provide a universal material which can be exposed with internal as well as external drum image-setters. The above objects are realized by the material specified in the claims. Preferred embodiments of the material of the present invention are specified in the dependent claims.

It is another object of the present invention to provide a method for making a printing master from a material which is characterized by the above advantageous properties. This object is realized by the methods defined in the claims. Preferred embodiments of this method are specified in the dependent claims.

Further advantages and embodiments of the present invention will become apparent from the following description.

DETAILED DESCRIPTION OF THE INVENTION

Heat-mode materials have been described in the prior art wherein a light absorbing compound is used as a light-to-heat converter and wherein the heat generated upon exposure triggers reactive compounds to undergo a (physico-) chemical reaction. Due to the presence of reactive compound(s), care must be taken with regard to storage conditions to guarantee a long shelf life of the material. In such materials the near infrared light absorbing compound is present in a typical amount relative to all the compounds in the material, excluding the support, of 1 to 10% by weight.

It is surprising that, according to the present invention, the presence of other reactive compounds besides the near infrared,light absorbing compound is not essential and a printing master may be obtained by exposing a material comprising a metal support and provided thereon one layer or a stack of layers, characterized in that said layer or stack of layers comprises a near infrared light absorbing compound in an amount not less than 50% by weight, relative to all the compounds present in said layer or stack of layers, and that the amount of other reactive compounds in said layer or stack of layers is not more than 20% by weight, relative to all the compounds present in said layer or stack of layers.

In addition to this surprising effect, the materials of the present invention require no processing or can be processed with plain water. The latter property makes them very suitable for computer-to-press and on-press coating procedures. Another major benefit of the materials of the present invention is the excellent stability: they can be stored during 2 minutes at 100° C. without toning (ink acceptance in non-exposed areas), contrary to conventional thermal lithographic printing plate precursors which show significant toning when exposed to the above conditions. Some materials according to the present invention, especially those comprising carbon as a near infrared light absorbing compound, can even be stored during 2 minutes at 150° C. without noticeable toning.

The imaging mechanism of the materials according to the present invention is not known, but may rely on a thermal interaction between the near infrared light absorbing compound and the metal support. For instance, it was observed that the aluminum signal measured by secondary ion mass spectroscopy while sputtering away the upper 2 nm from the surface of a material, consisting of an anodized aluminum support and a layer consisting exclusively of near infrared light absorbing compound, drops upon image-wise exposure down to 50% or even 10% of the signal measured at unexposed areas, the specific value being highly dependent on the structure of the near infrared light absorbing compound used.

The features of the present invention, as specified in the claims, shall be understood as indicated hereafter. The term "imaging material" as used herein embraces a plate precursor consisting of a sheet-like metal support and one or more functional layers as well as a composition which may be applied directly on a cylinder of a printing press. In the latter embodiment the cylinder is the metal support of the material according to the present invention. The word "image" is used herein in the context of lithographic printing, i.e. "a pattern consisting of oleophilic and hydrophilic areas". The material of the present invention is negative working, which means that the areas, which are exposed to light, are rendered oleophilic and thus ink accepting due to said exposure. In the context of the present invention, the feature "negative working" may be considered as an equivalent of the feature "non-ablative", since in ablative materials the functional layers are completely removed from the underlying (hydrophilic) metal support upon image-wise exposure so as to obtain a positive image (exposed areas are hydrophilic, ink repelling). Analysis of the exposed areas of the material according to the present invention indeed showed that the layer or stack of layers is not completely removed upon image-wise exposure but is converted into a hydrophobic surface on the metal support. The unexposed areas are hydrophilic or become hydrophilic after processing with plain water.

The feature "compound present in an amount not less than 50% by weight relative to said layer or stack of layers" may be referred to herein briefly as "main compound" (of said layer or stack of layers) and both terms shall be considered equivalent and are used hereinafter interchangeably. The near infrared light absorbing compound is the main compound relative to all the compounds in all the layers of the material, excluding the metal support. In a preferred embodiment the amount of near infrared light absorbing compound is not less than 70% by weight and even more preferably not less than 90% by weight relative to the layer(s) of the material excluding the support. In a highly preferred embodiment the layer or stack of layers consists essentially of a near infrared light absorbing compound. Mixtures of near infrared light absorbing compounds can also be used, and then, the total amount of all near infrared light absorbing compounds relative to all the compounds in all the layer(s) of the material excluding the support is not less than 50% by weight, preferably not less than 70% by weight and even more preferably not less than 90% by weight.

Though the layer or stack of layers may comprise other compounds in addition to the near infrared light absorbing compound, the amount of other reactive compounds besides the near infrared light absorbing compound is less than 20% by weight relative to all the compounds in the layer or stack of layers that are provided on the metal support. The feature "reactive compound" shall be understood as a compound which undergoes a (physico-)chemical reaction due to the heat generated during image-wise exposure. Examples of such reactive compounds are thermoplastic polymer latex, diazo resins, naphtoquinone diazide, photopolymers, resole and novolac resins, or modified poly(vinyl butyral) binders. More examples can be found in J. Prakt. Chem. Vol. 336 (1994), p. 377–389.

More preferably the amount of said other reactive compounds is less than 10% by weight and most preferably, the material is substantially free from reactive compounds other than the near infrared light absorbing compound. The words "substantially free" shall be understood as meaning that a small ineffective amount of such reactive compounds may be present in addition to the near infrared light absorbing compound. Said small ineffective amount is not essential for or does not significantly contribute to the imaging process of the material. This can be tested easily by preparing a material without said small amount of reactive compounds and establishing whether the material thus obtained can still be used to make a printing master. The threshold value below which the amount of the other reactive compounds, besides the near infrared light absorbing compound, may be regarded as "ineffective" depends on the nature of the reactive compounds.

According to the present invention, the material may further comprise non-reactive compounds, i.e. inert components such as e.g. a binder, surfactant, matting agent or filler. The word "inert" shall not be understood in the meaning of "non-functional", since these inert compounds may be added to the material to adjust certain physical properties, such as e.g. surface roughness, friction coefficient, viscosity or dimensional stability. The word "inert" shall rather be understood as meaning "not essential for the imaging process", though some inert compounds may have a (minor) influence on the speed and image quality of the material.

Examples of such inert compounds are hydrophilic binders, e.g. carboxymethyl cellulose, homopolymers and copolymers of vinyl pyrrolidone, vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The amount of hydrophilic binder in the layer or stack of layers is preferably less than 40% by weight and more preferably between 5 and 20% by weight.

The material of the present invention may comprise a stack of layers but a single layer is preferred. The near infrared light absorbing compound may be present in all the layers of said stack or may be localized in just a single layer of said stack. In a material according to the latter embodiment the layer comprising the near infrared light absorbing compound is preferably applied directly on the metal support. The layer comprising the near infrared light absorbing compound is preferably very thin, i.e. having a dry layer thickness below 1 μm, preferably below 0.4 μm and even more preferably ranging from 0.1 to 0.25 μm. A layer thickness below 0.1 μm may still give satisfactory results. For instance, it was observed that an anodized aluminum support provided with a 0.1 μm layer consisting of a near infrared light absorbing compound, which is cleaned by wiping thoroughly with a dry cloth and then image-wise exposed, still provides an excellent printing master.

The support used in the present invention is a metal support. Preferred examples of said metal support are steel, especially polished stainless steel, and aluminum. Phosphor bronze (an alloy comprising >90 wt. % of copper, <10 wt. % of tin and small amounts of phosphor) can also be used. The aluminum support is preferably an electrochemically grained and anodized aluminum support. Most preferably said aluminum support is grained in nitric acid, yielding imaging elements with a higher sensitivity. The anodized aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or can be carried out at a slightly elevated temperature of about 30 to 50° C. A further treatment may involve rinsing the aluminum oxide surface with a bicarbonate solution. Still further, the aluminum oxide surface may be treated with poly(vinyl phosphonic acid), poly(vinyl methylphosphonic acid), phosphoric acid esters of poly (vinyl alcohol), poly(vinyl sulphonic acid), poly(vinyl benzenesulphonic acid), sulphuric acid esters of poly(vinyl alcohol), and acetals of poly(vinyl alcohols) formed by reaction with a sulphonated aliphatic aldehyde. It is evident that one or more of these post treatments may be carried out alone or in combination.

A highly preferred material according to the present invention comprises an anodized aluminum support and provided directly thereon a single recording layer which consists essentially of a near infrared light absorbing compound and is substantially free from other reactive compounds. On top of said recording layer there may be provided a top layer for protecting the recording layer against moisture, chemicals, oxygen, mechanical impact, etc.

The near infrared light absorbing compound used in the present invention is an organic or carbon-based compound which is capable of converting near infrared light into heat. Also $MoS_2$ provides acceptable results. Useful organic compounds are for example organic dyes or polymers such as a polypyrrole or polyaniline-based polymer dispersions. The term 'carbon-based' compound means any compound which consists mainly of carbon atoms such as dispersed carbon, graphite, sot fullerenes, or charcoal. Dispersed carbon and the infrared dyes listed in Table 1 are highly preferred.

TABLE 1
Cpd 1
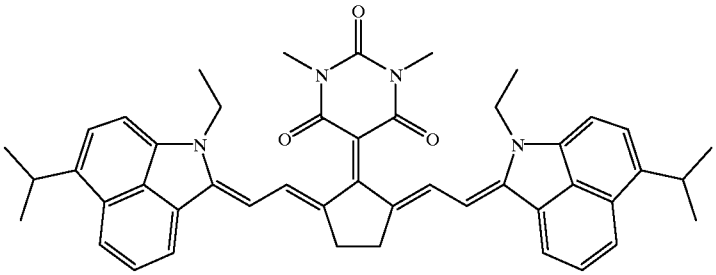
Cpd 2
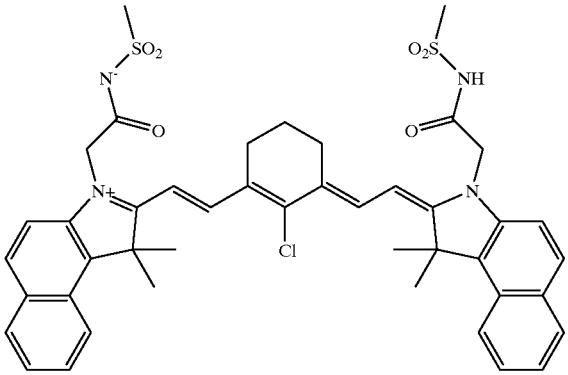
Cpd 3
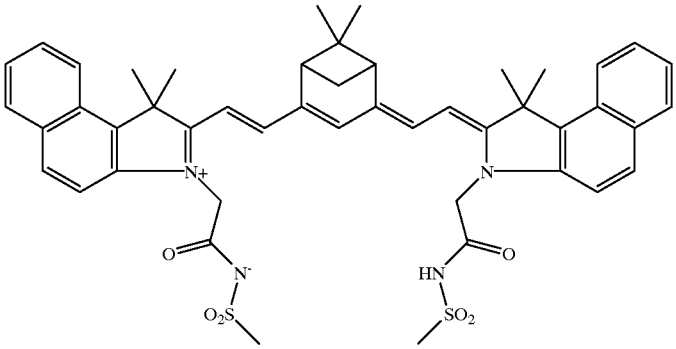
Cpd 4
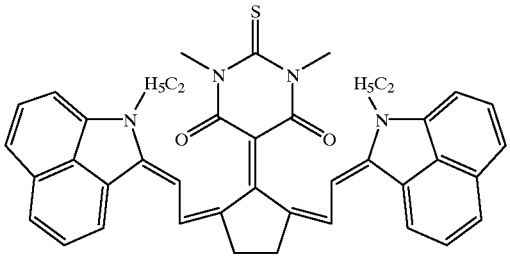
Cpd 5
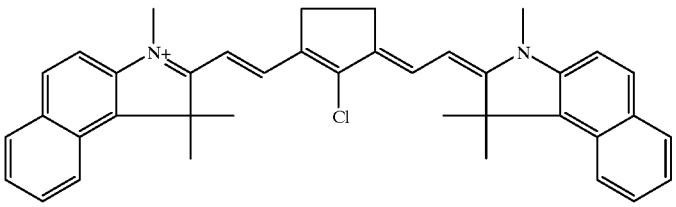

TABLE 1-continued
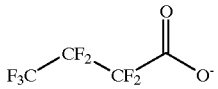
Cpd 6
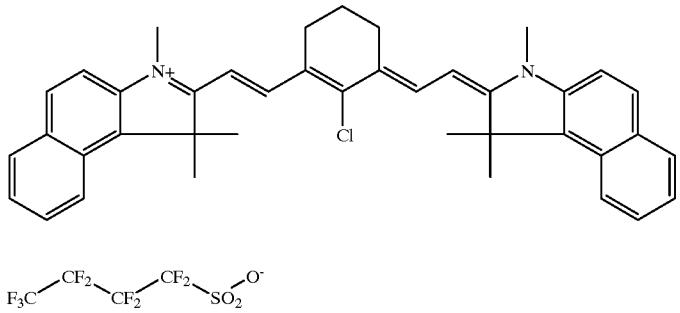
Cpd 7
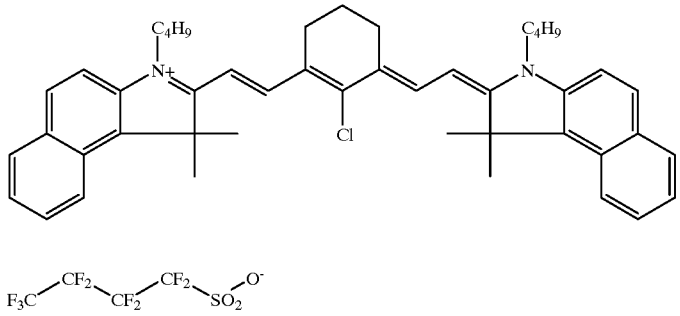
Cpd 8
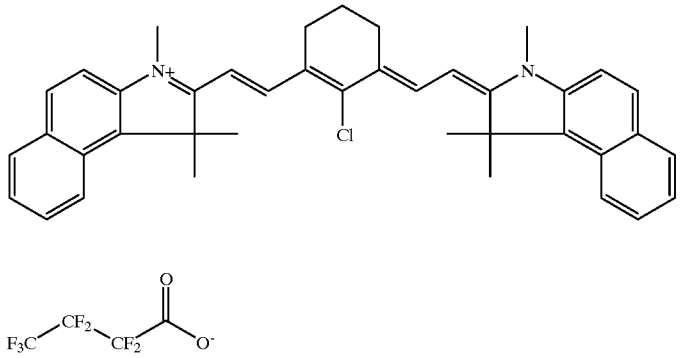
Cpd 9
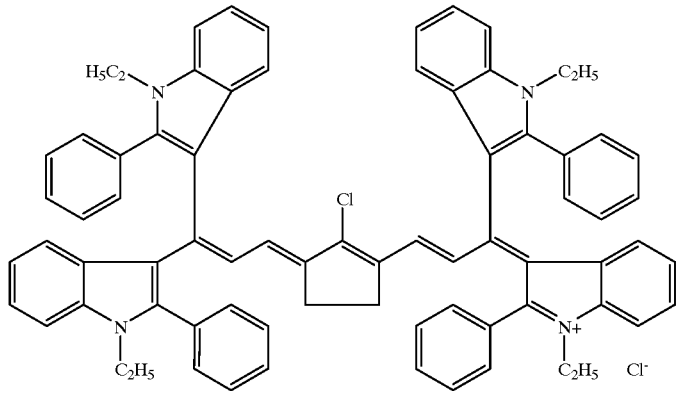

TABLE 1-continued

Cpd 10

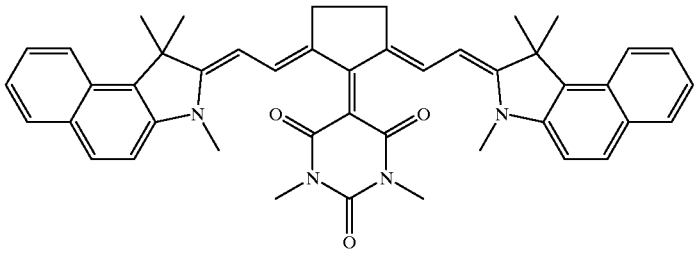

Cpd 11

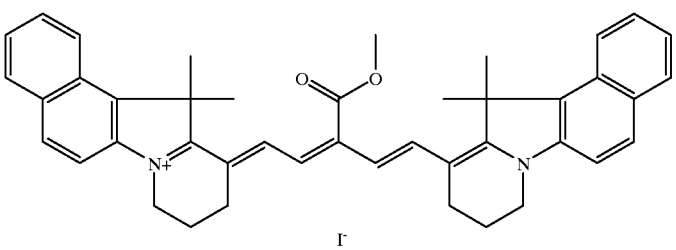

The near infrared light absorbing compound can be applied on the metal support by coating a solution or dispersion of said compound using the known coating techniques. Coating of an aqueous dispersion of carbon or a solution of an organic dye on a metal support are highly preferred embodiments of the method according to the present invention. Jet methods can be used as an alternative coating technique, whereby either a uniform layer of near infrared absorbing compound is jet-coated on the metal support and then image-wise exposed or whereby the near infrared light absorbing compound is image-wise applied to the metal support and then rendered hydrophobic by intense overall heating, e.g. by infrared laser exposure. The material of the present invention can also be prepared by rubbing in a metal support with a dry powder of a near infrared light absorbing compound, e.g. carbon or an organic dye.

The material of the present invention can be used in computer-to-plate (off-press exposure) or computer-to-press (on-press exposure) procedures. The material can also be prepared by on-press coating, i.e. by applying a composition, comprising a near infrared light absorbing compound as main component and not more than 20% by weight of other reactive compounds, directly on the metal surface of a cylinder of a rotary printing press. Said on-press coating can also be performed indirectly by applying said composition on a metal support which is mounted on a cylinder of a rotary printing press. In still another method according to the present invention, said composition can be applied on a metal sleeve which, after image-wise exposure and optional processing, is then transferred to a cylinder of a rotary printing press.

The materials of the present invention may be exposed to near infrared light having a wavelength ranging from about 700 to about 1500 nm by a light source such as a light emitting diode or a laser, e.g. a semiconductor laser diode, a Nd:YAG or a Nd:YLF laser. The required laser power depends on the pixel dwell time of the laser beam, which is determined by the spot diameter (typical value of modern plate-setters at $1/e^2$ of maximum intensity: 10–25 $\mu$m), the scan speed and the resolution (i.e. the number of distinct pixels per unit of linear distance, often expressed in dots per inch or dpi; typical value: 1000–4000 dpi). A major benefit of materials according to the present invention is that they can be used as a universal imaging material which is suitable for exposure by internal (ITD) as well as external drum (XTD) image-setters. ITD image-setters are typically characterized by very high scan speeds up to 500 m/sec and may require a laser power of several Watts. Satisfactory results have also been obtained by using XTD image-setters having a typical laser power from 100 mW to 500 mW at a lower scan speed, e.g. from 0.1 to 10 m/sec.

The unexposed areas of the material according to the present invention can be removed easily by wiping the material after exposure with plain water. This step may be performed on-press, i.e. after mounting the exposed plate on the plate cylinder of a printing press. The materials of the present invention can even be used as a printing master immediately after image-wise exposure without any additional processing because the unexposed areas are readily removed by the fountain solution or the ink applied during the first runs of the printing job.

EXAMPLES

While the present invention will hereinafter be described in connection with preferred embodiments thereof, it will be understood that it is not intended to limit the invention to those embodiments.

Example 1

A solution of 1 wt. % of cpd 1, defined above, in methylethyl ketone was prepared by stirring vigorously during 1 hour. This solution was coated at a wet thickness of 20 $\mu$m on an anodized aluminum support and then dried during 20 min. at 50° C. Infrared reflection spectra showed that the plate absorbed light at 830 as well as 1060 nm. After exposure with an XTD laser diode unit as an image-setter (wavelength 830 nm, power 1.6 W, scan speed 3.2 m/sec, spot size 11 $\mu$m, pitch 7 $\mu$m), the plate was used as a master without any further processing on an Oliver 52 printing press (trade name of Sakurai), using K+E 800 ink, available from Skinnex, BASF, and a fountain solution obtained by mixing aqueous dilutions of 3 wt. % Tame EC 7035 and 4 wt. % Aqua Ayde 7022, both trade names of Anchor. Good prints were obtained with low toning (ink acceptance at non-image areas). Similar results were obtained using an ITD 42T image-setter with a Nd:YAG laser source (1064 nm, 7100 mW, 183.5 m/sec, spot size 24 μm, pitch 10 μm).

Example 2

Cpd 2 was dissolved in water by adding one equivalent of triethyl amine and stirring. This solution was coated at a coverage of 200 mg/M$^2$ of dye on an anodized aluminum support and then dried during 20 min. at 50° C. This material was exposed using the same XTD image setter as described in Example 1 using a scan speed of 3.2 and 8.0 m/sec and a laser power of 228 and 305 mW (four different combinations, exposed on different areas of the plate). The material was then used as a master without any further processing on a GTO 46 press, supplied by Heidelberg, using Rubber Base Plus VS2329 Universal Black ink, trade name of Van Son, and Rota-Matic fountain solution, trade name of Rotaprint. A print job of 100 copies provided high quality prints over the whole area of the plate. Similar results were obtained with Cpd 3.

Example 3

An aqueous dispersion of 10 wt. % of carbon (Printex U, trade name, supplied by Degussa), which also contained 1.5 wt. % of Hyamine 1622, a cationic surfactant available from Merck, 2 wt. % of polyvinyl alcohol and a small amount of formaldehyde, was diluted with water and coated on an anodized aluminum support at a wet thickness of 40 μm. After drying during 20 minutes at 50° C. a plate precursor was obtained having a dry layer coverage of 200 mg/M$^2$. This material was exposed with a Nd:YAG XTD laser imager (1064 nm) at a power of 450 mW and a scan speed of 3 m/sec. After being mounted on the plate cylinder, the material was cleaned with a sponge which was moistened with plain water. Good prints were obtained in a print job using the same press, ink and fountain as in Example 1. A similar plate, coated at a layer coverage of 100 mg/m$^2$, provided printed copies of a significantly lower quality.

Example 4

A solution of 0.75 wt. % of Cpd 4 in methylethyl ketone was prepared by stirring vigorously during 30 min. followed by ultrasonic treatment during 30 min. Two samples were prepared by coating this solution on an anodized aluminum support at a wet thickness of 20 μm and 40 μm respectively and then dried during 20 min. at 50° C. Both these plate precursors could be used as a printing master after image-wise exposure at 830 nm with a power of 738 mW and a scan speed of 3.2 or 8.0 m/sec (two different exposures on different areas of each plate), and then processing the material by wiping with plain water (image-setter, press, ink and fountain as in Example 1).

Example 5

An aqueous dispersion of 10 wt. % of carbon (Printex U as in Example 3) was coated on an anodized aluminum support and allowed to dry during 20 min. at 50° C. Two samples were prepared at a dry coverage of 100 and 200 mg/m$^2$. Similar materials were prepared with an aqueous dispersion containing 10 wt. % of carbon and 2 wt. % of polyvinyl alcohol. These four plates were exposed with an XTD Nd:YLF laser at a power of 364 and 728 mW and a scan speed of 3.2 and 8.0 m/sec (four combinations on different areas of the same plate). Without further processing, the plates were used as a master on a GTO 46 press (trade name of Heidelberg) using the same ink and fountain as in Example 1. It was observed that the plates containing polyvinyl alcohol had a higher speed and could be exposed using a laser power of 364 mW with satisfactory results.

Example 6

Cpd 2 was dissolved in water by adding one equivalent of triethyl amine and stirring. Three coating solutions were prepared by adding an aqueous solution of a non-reactive hydrophilic binder, i.e. polyvinyl pyrrolidone, polyvinyl alcohol and carboxymethyl cellulose respectively. These solutions were each coated on an anodized aluminum support and then dried during 20 min. at 50° C. so as to obtain different samples having a dry coverage of 200, 300 and 400 mg/m$^2$. The coverage of the above mentioned polymers polyvinyl pyrrolidone, polyvinyl alcohol and carboxymethyl cellulose was 10 wt. % relative to the total layer coverage. These plates provided good printing results in a print job of 100 copies after exposure at 830 nm with a laser power of 300 mW and a scan speed of 3.2 or 8.0 m/sec (two different exposures on different areas of each plate) and then wiping the plates with plain water (image setter, press, ink and fountain as in Example 1).

Example 7

Cpd 5, Cpd 6, Cpd 7 and Cpd 8 were each dissolved in methanol at a concentration of 1.0 wt. % and these solutions were then each coated on an anodized aluminum support and then allowed to dry during 20 min. at 50° C. so as to obtain four different samples at a dry coverage of 100 mg/m$^2$. The experiment was repeated at a dry coverage of 500 mg/m$^2$. After exposure at 830 nm (300 mW, scan speed of 3.2 or 8.0 m/sec, two different exposures on different areas of each plate), the plates were moistened with plain water. Most plates provided good copies in a print job of 100 runs (image-setter, press, ink and fountain as in Example 1). The quality that was obtained depended on the scan speed used during exposure.

Example 8

An aqueous dispersion containing 10 wt. % of carbon (Printex U as in Example 3) and 1.2 wt. % of Alkonol XC, a tenside available from DuPont, was diluted with water 20-fold and then coated on an anodized aluminum support. After drying during 20 min. at 50° C., a layer having a dry coverage of 200 mg/m$^2$ was obtained. A 0.125 wt. % aqueous solution of polyvinyl alcohol (Polyviol VX 48 20, trade name of Wacker-Chemie) was then coated on top of the first layer so as to obtain a protecting layer having a dry coverage of 12.5 mg/m$^2$. The experiment was repeated with a protective layer of 50 mg/m$^2$. These materials were exposed with a Nd:YLF XTD image-setter (1060 nm) at a laser power of 660 mW and a scan speed of 3.2 and 8.0 m/sec (two different exposures on different areas of each plate). All the samples provided good printed copies using the same press, ink and fountain as in Example 1.

Example 9

Three plate precursors were prepared by rubbing in the surface of an anodized aluminum plate with a dry powder consisting of Cpd 1, Cpd 4 or Cpd 9 respectively. The samples were image-wise exposed with an XTD Nd:YLF laser (1060 nm) with a power of 150 mW at a scan speed of 2 m/sec. The plates thus obtained were used as a master in a print job using the same press, ink and fountain as in Example 1. No special measures were taken to ensure that the layer had a uniform thickness over the whole surface of the plate and it was observed that the plates were completely hydrophobic at the center, where the coating thickness was the highest, regardless whether the plate had been exposed at that area or not. At the edges, where the layer was much thinner, a good printing quality was obtained with no toning in the non-exposed areas, indicating that a low layer thickness is preferred for these near infrared light absorbing compounds.

Example 10

The content of an ink jet cassette Lexmark Schwarz, type 4076 (trade name of Lexmark) was diluted 10-fold with water, coated on an anodized aluminum support at a wet thickness of 40 $\mu$m and then dried at 50° C. This material was exposed with a Nd:YLF XTD image-setter (1060 nm) at a laser power of 150 mW or 450 mW and a scan speed of 2 or 4 m/sec (four different combinations on different areas of the plate). The plate was mounted on the plate cylinder, moistened with water and good prints were obtained in a print job of 100 copies (same press, ink and fountain as in Example 1).

Example 11

An aqueous dispersion containing 10 wt. % of carbon (Printex U as in Example 3) and 1.2 wt. % of Alkonol XC, a tenside available from DuPont, was mixed with a 20% dispersion of poly(vinyl pyrrolidone) (PVP) as a non-reactive hydrophilic binder so as to obtain a weight ratio of carbon vs. PVP of 1:9. Water was added up to a total concentration of 0.5% and then 0.05% of cetyltriethyl ammonium bromide was added as a spreading agent. Samples 10-1 and 10-2 were obtained by coating this solution on an anodized aluminum support at a wet thickness of 20 and 40 $\mu$m respectively and then drying during 20 minutes at 50° C. The total coverage of carbon and PVP of samples 10-1 and 10-2 was 100 and 200 mg/m$^2$ respectively. Other samples having a different weight ratio of carbon vs. PVP as indicated in Table 2 were prepared according to the same procedure. These samples were exposed with the same image-setter as in Example 1 at a laser power of 305 mW and a print job was started using the same press, fountain and ink as in Example 1. None of the plates showed toning. The visible contrast of the printed copies was established by visual inspection of the optical density of the printed areas corresponding to the hydrophobic areas of the plate. Said visual contrast is expressed in Table 2 as a number on a scale from 0 (no visible density) to 10 (very high density). It may be concluded from Table 2 that the plates having more than 50% of carbon provide the best results. However the plates comprising no PVP show less contrast than the plates with a carbon vs. PVP ratio of 9:1, indicating that a small amount of hydrophilic binder is beneficial.

TABLE 2

| sample no. | carbon vs. PVP | total coverage (mg/m$^2$) | visible contrast (0–10) |
|---|---|---|---|
| 10-1 | 1:9 | 100 | 1 |
| 10-2 | 1:9 | 200 | 1 |
| 10-3 | 3:7 | 100 | 2 |
| 10-4 | 3:7 | 200 | 4 |
| 10-5 | 5:5 | 100 | 2 |
| 10-6 | 5:5 | 200 | 6 |
| 10-7 | 7:3 | 100 | 3 |
| 10-8 | 7:3 | 200 | 8 |
| 10-9 | 9:1 | 100 | 5 |
| 10-10 | 9:1 | 200 | 10 |
| 10-11 | 10:0 | 100 | 4 |
| 10-12 | 10:0 | 200 | 7 |

Example 11

Table 3 shows the composition of ten plates of which some correspond to the invention and others are comparative examples comprising other reactive compounds, such as a novolac or thermoplastic polymer latex, besides the near infrared light absorbing compound which is carbon in all cases. Samples no. 11-1, 11-2, 11-3 and 11-4 comprised no other reactive compound besides carbon. The amount of other reactive compounds besides the near infrared light absorbing compound was less than 10% in samples no. 11-5 and 11-6 and more than 20% in 11-7, 11-8, 11-9 and 11-10.

The samples were prepared using the same coating methods as above. In addition to the composition given in Table 3 a small amount of surfactant was added to the coating solution as spreading agent. All these plates were subjected to a thermal treatment as indicated in Table 3 and were then used as a printing master without any exposure. The plates according to the invention showed no toning (no ink acceptance due to the thermal treatment), which is indicated as "ok" in Table 3. The plates comprising other reactive compounds besides carbon showed toning (some ink acceptance) or were even completely hydrophobic (very high ink acceptance over the whole plate), indicated as "X" in Table 3.

TABLE 3

| sample no. | Composition (wt. %), amount of other reactive compound besides carbon underlined | Thermal treatment: none | 2 min. 100° C. | 2 min. 150° C. |
|---|---|---|---|---|
| 11-1 | 74.1% of carbon Printex U (b)<br>11.1% of Hyamine 1622 (a)<br>14.8% of poly(vinyl alcohol) | ok | ok | toning |
| 11-2 | 83.3% of carbon Printex L6 (b)<br>16.7% of poly(vinyl alcohol) | ok | ok | toning |
| 11-3 | 64.5% of carbon Printex U (b)<br>9.7% Hyamine 1622 (a)<br>12.9% of poly(vinyl alcohol)<br>12.9% of poly(vinyl pyrrolidone) | ok | ok | slightly toning |
| 11-4 | 83.3% of carbon Printex L6 (b)<br>16.7% of poly(acrylic acid) | ok | ok | ok |

TABLE 3-continued

| sample no. | Composition (wt. %), amount of other reactive compound besides carbon underlined | Thermal treatment none | 2 min. 100° C. | 2 min. 150° C. |
|---|---|---|---|---|
| 11-5 | 67.6% of carbon Printex U (b)<br>10.1% of Hyamine 1622 (a)<br>8.8% of a polystyrene latex (c)<br>13.5% of poly(vinyl alcohol) | ok | ok | toning |
| 11-6 | 61.3% of carbon Printex U (b)<br>9.2% of Hyamine 1622 (a)<br>8.0% of a polystyrene latex (c)<br>12.3% of poly(vinyl alcohol)<br>9.2% of poly(vinyl pyrrolidone) | ok | ok | toning |
| 11-7 | 76.9% of carbon Printex U (b)<br>7.6% of nitrocellulose<br>15.5% of novolak (d) | toning | X | X |
| 11-8 | 9.4% of carbon Printex U (b)<br>10.7% of 3,4,5-trimethoxybenzoic acid<br>78.8% of novolak (d)<br>1.1% of nitrocellulose | toning | X | X |
| 11-9 | 10% of IR absorbing dye (e)<br>75% of polystyrene latex (c)<br>15% of poly(acrylic acid) | OK | toning | X |
| 11-10 | 10% of carbon Printex L6 (b)<br>80% of polystyrene latex (c)<br>10% of terpolymer (f) | toning | toning | toning |

(a) trade name defined above
(b) trade name of Degussa
(c) a thermoplastic latex of average size 66 nm and molecular weight 200 000.
(d) a phenol/cresol formaldehyde resin
(e) the dye has the following structure:

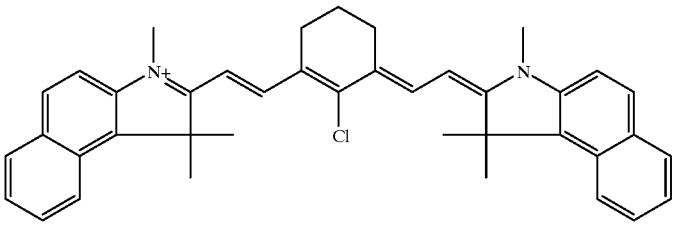

(f) a copolymer of vinyl alcohol, vinyl acetate, vinyl butyral and the vinyl ester of benzenetricaboxylic acid as described in European Patent Application No. 98201272, filed on Apr. 4, 1998.

Example 12

An aqueous carbon dispersion was prepared comprising 29 wt. % of Helioechtpapierschwartz A Regal 400R, available from Bayer AG (Germany) and 1 wt. % of Tamol NN9401, an anionic dispersing agent from BASF. An electrochemically grained and anodized aluminum support (thickness 0.30 mm) was coated with a solution containing 3.5 vol. % of the above carbon dispersion and 2 vol. % of an aqueous solution comprising 5 wt. % of n-polyoxyethylene-ethyl-perfluoro-octanoicamide (degree of polymerization of ethylene oxide is 17-20). The temperature of the aluminum support during coating was 40° C. The coated layer was dried during 20 minutes at 50° C. Three samples were prepared with a dry thickness of the coated layer of 0.1, 0.2 and 0.4 μm respectively.

These samples were exposed with a 200 line pairs /inch dot image using an XTD Nd:YLF laser having a power of 738 mW and a scan speed of 4 m/sec and then used as a printing plate in a similar press run as described in Example 1. Table 4 indicates that the plates with a layer thickness of 0.1 and 0.2 μm showed some dot gain. The dot reproduction of the plate having a layer thickness of 0.4 μm however was not acceptable.

TABLE 4

| Sample | layer thickness (μm) | printed dot (%) obtained upon exposure of a dot of 10% | 20% | 30% | 40% | 50% | 60% | 70% | 80% | 90% | 100% |
|---|---|---|---|---|---|---|---|---|---|---|---|
| 12-1 | 0.1 | 17 | 37 | 40 | 59 | 75 | 80 | 90 | 94 | 98 | 100 |
| 12-2 | 0.2 | 16 | 32 | 40 | 52 | 67 | 76 | 85 | 94 | 99 | 100 |
| 12-3 | 0.4 | 5 | 11 | 22 | 32 | 22 | 19 | 28 | 46 | 20 | 20 |

Having described in detail preferred embodiments of the current invention, it will now be apparent to those skilled in the art that numerous modifications can be made therein without departing from the scope of the invention as defined in the appending claims.

What is claimed is:

1. A negative working non-ablative imaging material which is suitable for making a lithographic printing master, said material comprising a metal support and provided thereon a uniform layer or a stack of uniform layers, wherein said uniform layer or stack of uniform layers comprises a near infrared light absorbing compound present in an amount not less than 50% by weight, relative to all compounds present in said uniform layer or stack of uniform layers, and that the amount of other reactive compounds in said uniform layer or stack of uniform layers is not more than 20% by weight, relative to all compounds present in said uniform layer or stack of uniform layers, characterized in that said near infrared light absorbing compound is an organic or carbon-based compound.

2. A material according to claim 1 wherein the amount of said other reactive compound is not more than 10% by weight.

3. A material according to claim 1 wherein the layer or stack of layers is substantially free from said other reactive compounds.

4. A material according to claim 1 wherein the amount of the near infrared light absorbing compound is not less than 70% by weight.

5. A material according to claim 1 wherein the amount of the near infrared light absorbing compound is not less than 90% by weight.

6. A material according to claim 1 wherein the layer or stack of layers further comprises a hydrophilic binder.

7. A material according to claim 1 wherein the stack of layers comprises a layer which is closest to the support and wherein the amount of near infrared light absorbing compound in said layer which is closest to the support is not less than 50% by weight.

8. A material according to claim 1 or 7 wherein the metal support is an anodized aluminum plate.

9. A method for making a lithographic printing master comprising the steps of image-wise exposing a material according to claim 1 to near infrared light;

optionally wiping the composition with water.

10. A negative working non-ablative imaging material which is suitable for making a lithographic printing master, said material comprising a metal support and provided thereon a layer or a stack of layers, wherein said layer or stack of layers comprises a near infrared light absorbing compound present in an amount not less than 50% by weight, relative to all compounds present in said layer or stack of layers, and that the amount of other reactive compounds in said layer or stack of layers is not more than 20% by weight relative to all compounds present in said layer or stack of layers, characterized in that said near infrared light absorbing compound is an organic or carbon-based compound, wherein the stack of layers comprises a layer which is closest to the support and wherein the amount of near infrared light absorbing compound in said layer which is closest to the support is not less than 50% by weight, and wherein the layer closest to the metal support consists essentially of near infrared light absorbing compound.

11. A material according to claim 10, wherein the layer closest to the support has a thickness not higher than 0.4 $\mu$m.

12. A method for making a lithographic printing master comprising the steps of applying a layer of a negative working non-ablative composition containing a near infrared light absorbing compound on a metal support;

image-wise exposing the composition to near infrared light;

optionally wiping the composition with water;

wherein said composition comprises a near infrared light absorbing compound in an amount not less than 50% by weight, relative to all the compounds present in said composition, and that the amount of other reactive compounds in said composition is not more than 20% by weight, relative to all the compounds present in said composition, characterized in that said near infrared light absorbing compound is an organic or carbon-based compound.

13. A method according to claim 12 wherein the metal support is an anodized aluminum plate.

14. A method according to claim 13 wherein the anodized aluminum plate is mounted on a cylinder of a rotary printing press.

15. A method according to claim 12 wherein the metal support is a sleeve or a cylinder of a rotary printing press.

* * * * *